United States Patent [19]

Gilmour

[11] Patent Number: 5,040,345

[45] Date of Patent: Aug. 20, 1991

[54] STUD CLIP FOR ALLOWING VERTICAL FLOATING MOVEMENT OF A FLOOR OR ROOF STRUCTURE

[76] Inventor: Michael F. Gilmour, 9008 NE. 102nd. St., Vancouver, Wash. 98662

[21] Appl. No.: 515,584

[22] Filed: Apr. 27, 1990

[51] Int. Cl.[5] ..... E04H 1/00

[52] U.S. Cl. ..... 52/243.1; 52/238.1; 52/241

[58] Field of Search ..... 52/238.1, 239, 241, 52/243, 243.1, 632

[56] References Cited

U.S. PATENT DOCUMENTS 3,492,766 2/1970 Andrews ..... 52/243.1 X 4,018,020 4/1977 Sauer et al. ..... 52/241

4,787,767 11/1988 Wendt ..... 52/241 X

*Primary Examiner*—David A. Scherbel

*Assistant Examiner*—Creighton Smith

[57] ABSTRACT

A stud clip for allowing vertical floating movement of a horizontal structure such as a roof element or floor element mounted thereon vertically slidingly associated with a fixed C shaped vertical non-load bearing building stud, said clip being generally U shaped and having a perimeter conforming to the interior cross section of said stud and engaging said interior including opposed recesses to receive inturned lips of said stud and affixed to said horizontal structure.

5 Claims, 3 Drawing Sheets

FIG. 1.
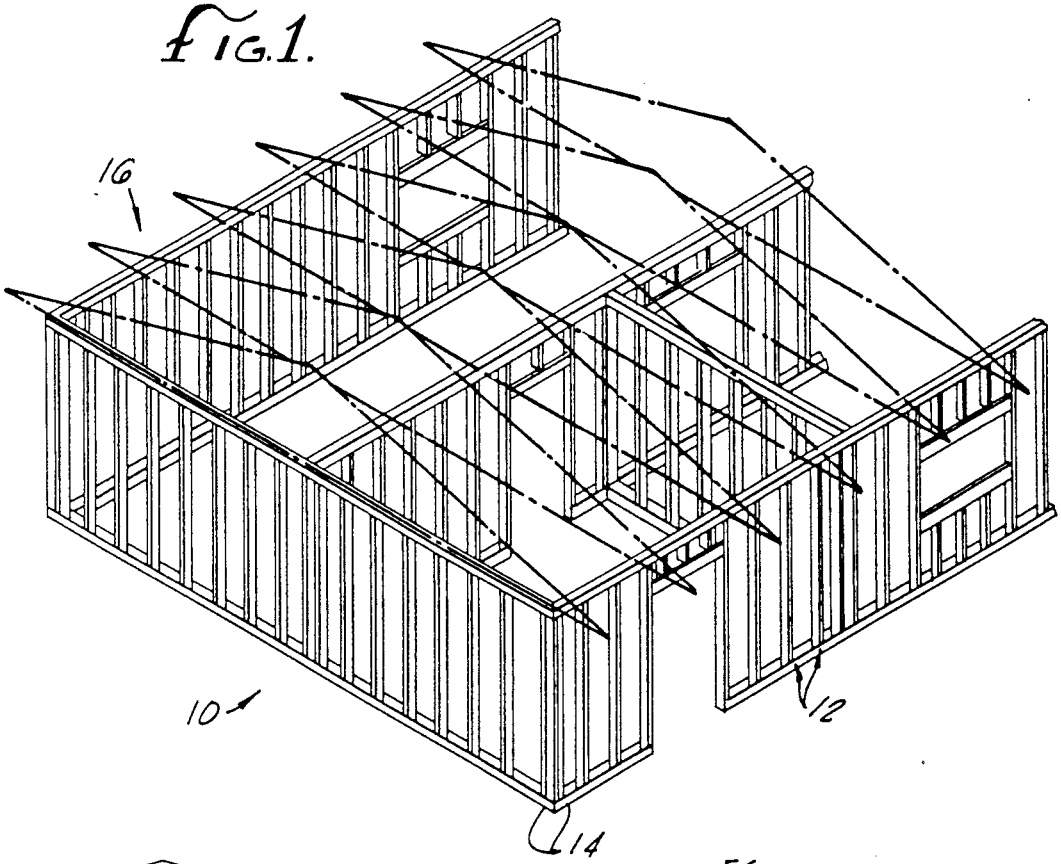
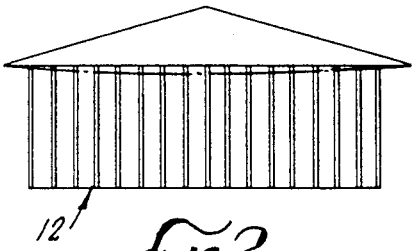
FIG. 2.
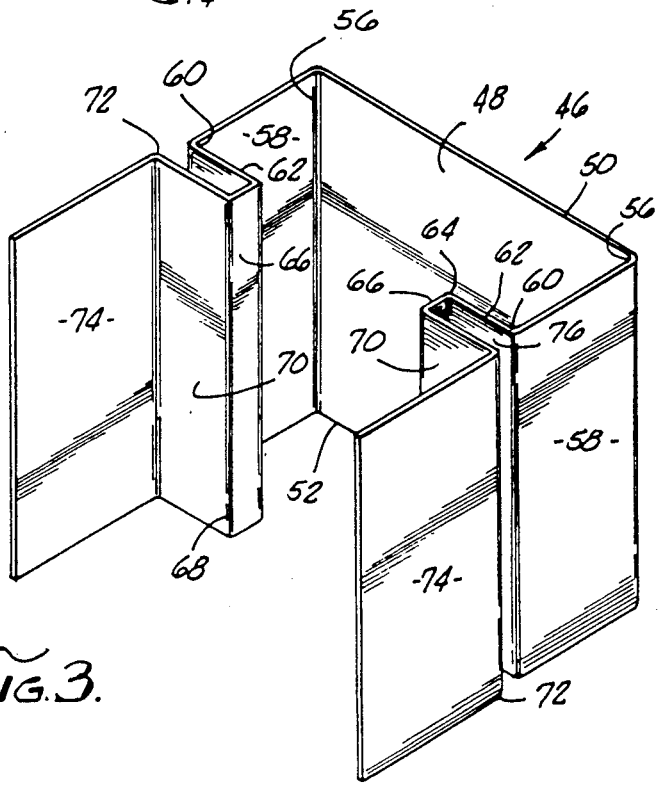
FIG. 3.

STUD CLIP FOR ALLOWING VERTICAL FLOATING MOVEMENT OF A FLOOR OR ROOF STRUCTURE

BACKGROUND OF THE INVENTION

1. Field of the Invention

This invention relates to a means for allowing a floor or roof to "float" in response to random loading (caused by increased live load), adverse environmental loading or earthquake motion loading that might otherwise cause cracks in the vertical wall covering which is applied to the vertical studs beneath the floor or roof system.

2. Background of the Invention

Prior to the present invention, vertical metal studs in the frame of a building were connected directly to metallic horizontal joists or top tracks that support and are affixed to the floor or roof. This meant that the vertical studs and horizontal joists for floors or roofs were rigidly secured to each other in a manner that allowed little, if any, vertical displacement of the floor or roof. The fixed relationship of nonload bearing or non-bearing studs and floors or roofs systems presented serious problems for heavy office floors, or in those parts of the country that receive heavy snow fall, as illustrations. In the case of the floors and the roofs a heavy load of snow causes a downward pressure on the vertical nonbearing studs. But because the horizontal members were rigidly secured to the vertical studs, there was not way to alleviate the downward pressure. The result was that the vertical pressure would cause unsightly and costly cracks in the wall coverings and generally weaken the wall beneath the structure. When the snow melted. the cracks in the walls would become larger as the walls expanded in response to the lessening vertical pressure from the snow-burdened joists.

In addition, in areas where there are exceedingly hot days such as in the desert and metal framing studs are used, roofs have a tendency to expand. With such expansion the roofs have no flexibility and upward movement will also cause the wall coverings to crack.

In the case of office and other types of building occupancies, it is commonly known that the floor system is differentially loaded at different times during the day or night. This loading is caused primarily by people and/or equipment. An example would be the office floor system that is loaded by people during work hours, at which time a larger downward pressure is being exerted on the non-bearing walls below. During the times in which the floor does not support extra loading, the floor system moves upward away from the non-bearing walls.

The present invention overcomes such problems of inflexibility that plagued the prior art building systems by providing horizontal roof, or floor joists that move vertically relative to the vertical studs. By allowing the top tracks to flex when the roof is subject to environmental pressure, the vertical forces on the roof top tracks are harmlessly released. In that manner, the vertical stresses caused by the environmental pressures and live loads or earthquake motion induce loading are never transmitted to the walls, thereby preventing the wall covering cracks that were a chronic problem in prior art structures.

SUMMARY OF THE INVENTION

It is the purpose of the present invention to provide a stud clip means slidable affixable to a vertical metallic stud and fixable to a horizontal structure such as a floor or roof top track to allow vertical movement of said floor or roof above said stud.

Another object of the present invention is to provide a stud clip having a cross sectional shape adapted to conform to the cross sectional C shape of a metallic stud as disclosed in U.S. Pat. No. 4,235,054 and fit within the same.

A further object of the present invention is to provide a stud clip that slides vertically on a C shaped metallic stud yet is fixedly secured to a floor or roof element and cannot be horizontally dislodged from said stud.

Another object of the present invention is to provide a stud clip that will allow approximately a one inch vertical play of a floor or roofing structure dependent upon climatic conditions.

A still further object of the present invention is to provide a stud clip that includes structure to prevent it from becoming horizontally disengaged from said metallic stud.

These and other objects and advantages will become apparent from the following part of the specification wherein details have been described for the competence of disclosure, without intending to limit the scope of the invention which is set forth in the appended claims.

BRIEF DESCRIPTION OF THE DRAWING

These advantages may be more clearly understood from the following detailed description and by reference to the drawing in which:

FIG. 1 is an environmental view of a building that would employ the present invention in conjunction with vertical metallic studs and a floor or roofing structure (shown in phantom lines);

FIG. 2 is a side elevational view of a building employing the present invention with the roof vertical fluctuations shown in phantom;

FIG. 3 is a perspective view of the metallic stud clip of the present invention;

DETAILED DESCRIPTION OF THE PREFERRED EMBODIMENT

Figure 4:
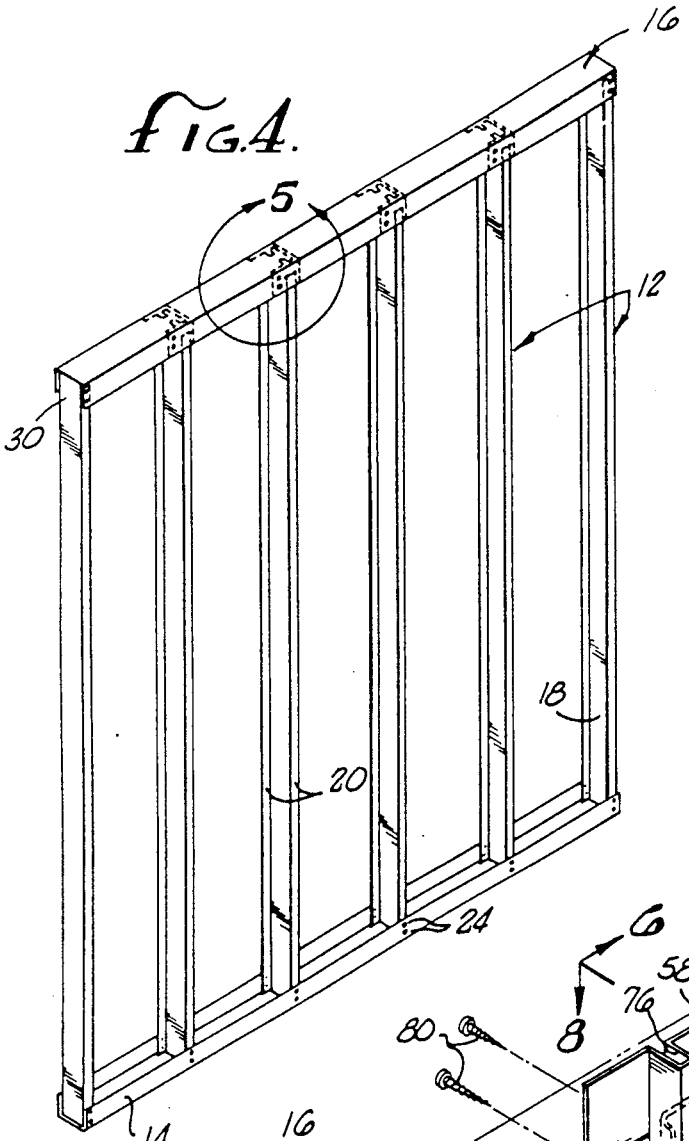
FIG. 4 is a perspective view of a wall frame section showing the studs and a top track employing the clip of the present invention.

In FIG. 1 there is illustrated a building framework generally designated 10 The framework includes a plurality of non-load bearing or non-bearing metallic C shaped vertical studs designated 12 with U shaped metallic lower or bottom track members 14, see FIG. 2, to which the studs 12 are fixed and an inverted U shaped metallic top track designated 16.

In the construction of a building there would usually be a plurality of building trusses, illustrated in phantom lines, FIG. 1 to receive a roof, not shown. The trusses are usually affixed to the top track 16 for stability. In addition, instead of roof trusses there may be floor joists above the frame work without departing from the spirit of the invention.

The non-load bearing metallic C shaped vertical studs 12 preferably rnclude a main web 18 and relatively narrow flanges 20 bent normal to the plane of the web and spaced from each other the width of the web 18. At the end of the flanges 20 they are bent inward toward each other from the plane of the flanges forming end lips 22. Thus in cross section the studs form a "C" thus the reference to them as C shaped vertical studs.

Each of the vertical studs which are non-load bearing may be roll-formed to the appropriate shape using a single gauge of metal.

In the construction of the metallic frame work 10 the U shaped lower track members 14 are secured to a foundation, not shown, see FIG. 4. Each stud is placed in the track and secured to the track by means of fasteners 24 at predetermined intervals along the track as may be prescribed by local building codes. Each of the studs 12 project upwardly terminating at top edges 28, see FIG. 5. Generally the studs 12 which form a wall will be maintained with respect to the top track 16 using the present invention. Affixation will be subsequently described; the top track 16 will fit over the stud end 28 and top portion 30 as shown in FIG. 4.

Figure 6:
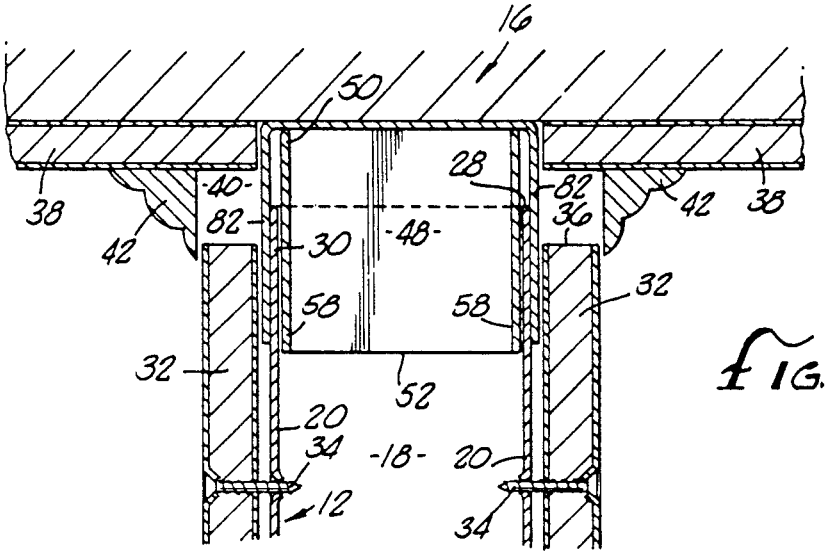
FIG. 6 is a cross sectional view taken on line 6—6 of FIG. 5 of the clip, wall and ceiling wherein the present invention is mounted and there is a space between the end of the vertical stud and the ceiling to allow for deflection of the structure above.
Figure 7:
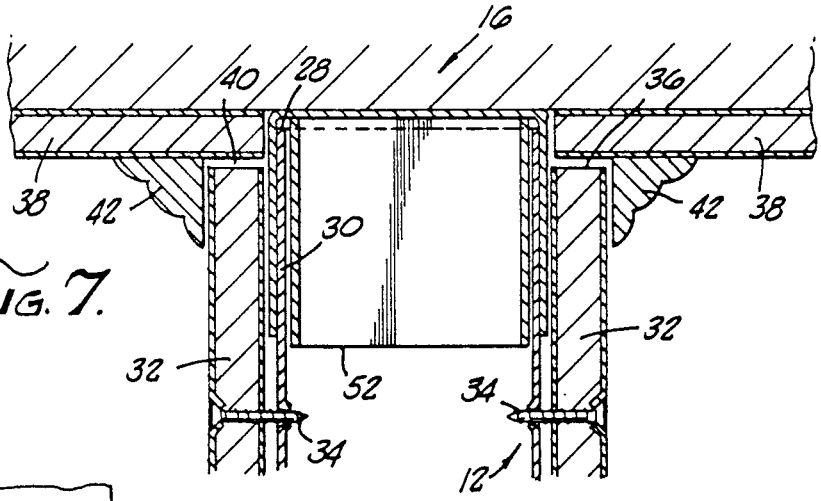
FIG. 7 cross-sectional view similar to FIG. 5 with the space reduce between the end of the stud and ceiling.
Figure 8:
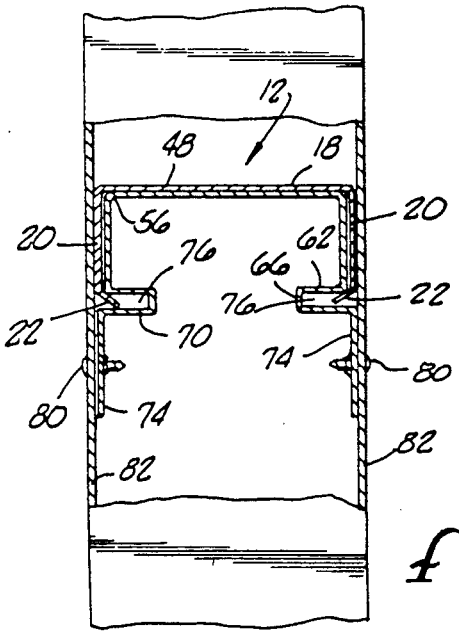
FIG. 8 is taken on line 8—8 of FIG. 6 showing a vertical cross section of the clip and stud together.

Once a frame wall has been completed such as in FIG. 1 and 4 it is usually traditional to affix wall board 32 to the studs by fasteners such as illustrated by fasteners 34 in FIGS. 6 and 7. The wall board 32 terminates in top edge 36. The top edge 36 of the board 32 in the present invention does not extend up to and fuse with a ceiling wall board 38. In actual construction a space 40 of approximately one inch is allowed between the edge 36 and ceiling 38 for a floor or roof expansion and/or contraction.

In order to hide the space 40 there is provided a molding 42 of sufficient depth to overlap the edge 36 of the wall board 32 when the space 40 is the greatest such as seen in FIG. 6.

In FIG. 3 there is illustrated the stud holder clip member designated 46. The clip member 46 is adapted to sliding interfit within the interior of the C shaped studs 12 to move up and down on the stud. However, the number 46 will prevent lateral or horizontal movement of the stud member 46.

Figure 5:
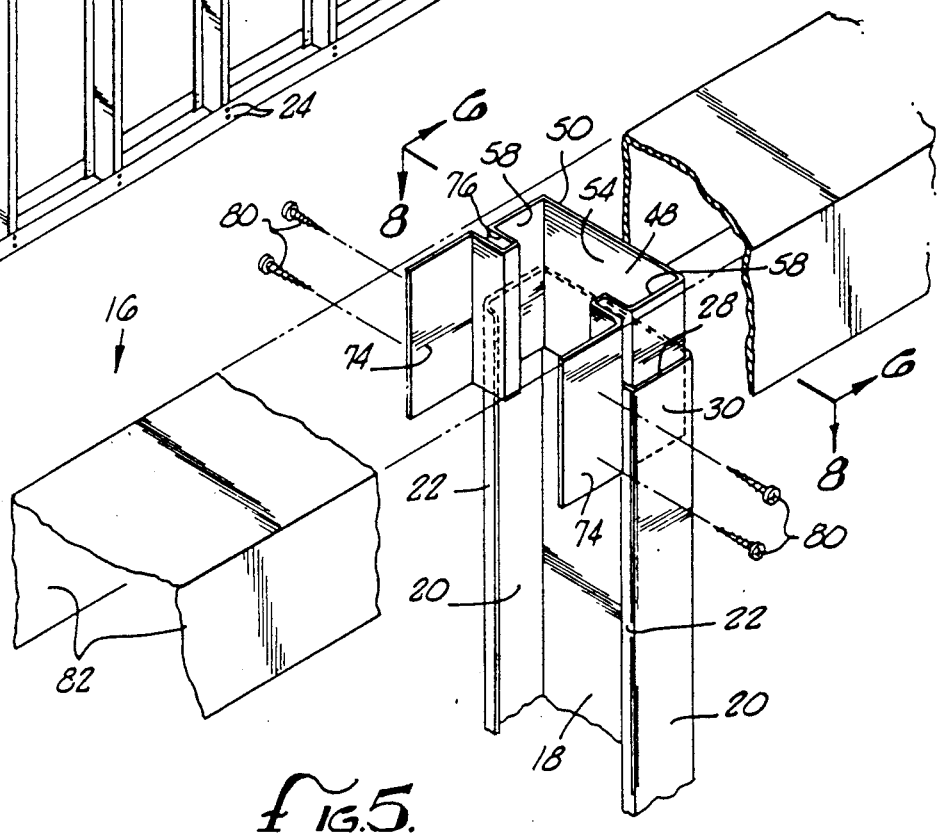
FIG. 5 is a partial sectional view of the present invention showing th of the present invention.

The clip member 46 includes a main web 48 with top edge 50 and bottom edge 52. The width of the web 48 is such as to correspond to the interior face width 54 such as seen in FIG. 5. The clip member 46, preferably formed of a single gauge steel sheet which is bent at bends 56 forming narrow flanges 58 that are adapted to interfit against the stud narrow flanges 20.

At bends 60 the metal of clip 46 is bent inwardly toward each other generally parallel to the plane of web 48 forming a first recess wall 62. At bend 64 the metal is bent normal to the plane of recess wall 62 to form end recess wall 66 and at bend 68 the metal is again bent to form second recess wall 70. At bend 72 a wall extension 74 is formed.

Thus, the clip 46 is generally U shaped and between the recess walls 62, 66, and 70 an end lip recess 76 is formed.

While the clip member 46 is preferably made of a single piece of bent steel, it may be made of other metals as well as extruded hard plastic without departing from the spirit of the invention.

To use the clip member 46 it is inserted into the C shaped stud 12 by sliding it in from the top edge 28 and top portion 30, see FIG. 5. As can be seen, the web 48 will slide against the stud web 18 and narrow flanges 58 will ride against the narrow flanges 20. The end lip recess 76 is wide enough to accommodate the end lips 22 of the stud 12. Such a fit as just described will allow the clip member 46 to move up and down in the stud 12 yet prevent horizontal dislodgment by the lips 22 being located in the recess 76.

In order to secure the clip 46 to a top track 16, fasteners 20, see FIG. 5, will pass through the exterior parallel leg 82 of the U shaped top track 16 and into the wall extensions 74. In some cases the fasteners 80 may be self taping and make the openings in the walls 82 and extensions 74 as they are inserted. While two fasteners 80 are illustrated for each side, one on each side may be sufficient.

As can be seen, with a plurality of clips 46 positioned in adjorning studs 12 the top track 16 attached thereto floats on the studs. In this way should snow settle on the roof various floating top tracks 12 thereunder may be depressed to the phantom line in FIG. 2 or to the bottom out of FIG. 7. This will prevent cracking of the wall coverings 32. By the same token where the building structure is located in extremely hot areas such as a desert, the roof may expand during the daytime and move the top tracks 16 to the extreme upper limit such as illustrated in FIG. 6. At night worth cooling temperatures the roof may contract and the tracks 16 will settle back down allowing the clips 46 to slide within the C studs 12.

The need for flexibility of the wall coverings may also be found on offices where there is an increase in weight on floors during the day causing movement of the floor. In addition, earthquakes may cause building movement and the clips 48 will lessen damage due to vertical movement of the walls.

While the invention has illustrated and discussed top tracks being connected to the clips 46, a roof structure or trusses may be directly attached to the clips 46 without departing from the spirit of the invention.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. Stud clip members for use with a building structure to allow a horizontal structure thereon such as a floor to vertically float thereon, said structure includes a plurality of non-load bearing C shaped studs having opposed inward turned vertical lip edges and having two ends one of which is secured to a U shaped lower track on a foundation and said studs are arranged in vertical spaced apart relationship one from the other, wall board affixed to said studs forming a fixed wall, an inverted U shaped to track member having parallel spaced apart side walls and overlaying said other end of said C shaped studs having a horizontal member integral therewith each clip comprising:

a generally U shaped clip having a perimeter to slidingly interfit within said one of said C shaped studs at said other end thereof, and including a pair of opposed lip recesses formed therein to receive said inward turned lip edges to prevent lateral movement of said clip from said stud, track mounting means formed on said clip united with said walls of said invented U shaped top track, whereby movement of said top track due to vertical shifting of said horizontal member will translate to a sliding movement of said clip within said stud without movement of said stud and said wal board attached thereto.

2. Stud clip members as defined in claim 1 wherein each of said clip members includes:

a main web portion of a height less than the length of said C shaped stud;

a pair of opposed generally parallel narrow flanges projecting from said main web and normal to the plane of said main web;

a pair of opposed inwardly extending lip receiving recesses projecting from said parallel narrow flanges; and wherein said track mounting means are each a pair of wall extensions each projecting from one of said recesses and on a plane with said parallel narrow flanges, said wall extensions each engaging one of said spaced apart side walls and fixedly united therewith.

3. Stud clip members as defined in claim 2 wherein:

each of said elements of each of said members are of the same length; and said clip is formed from a single steel sheet.

4. A building system frame of metallic members adapted to allow a horizontal structure such as a floor mounted thereon to vertically shift on said members to prevent damage to wall coverings forming a part of said system and positioned under said horizontal structure comprising:

a U shaped lower metallic track secured to a building foundation;

a plurality of vertical metallic studs having a bottom and top end and being C shaped in cross section with a main web, narrow flanges projecting from said web and said flanges terminate in inturned opposed lips, said bottom end of each of said studs interfitted within said lower track at spaced intervals and each stud affixed to said track;

wall covering secured to at least one side of said studs extending from said track to adjacent the top end of said studs;

an inverted U shaped metallic top track having parallel opposed side legs overlying the top end of said studs adapted to receive thereon a paortion of said horizontal structure;

stud clip members, one for each of said studs, slidably mounted in said studs at the top ends thereof, each of said clip members being permanently affixed to said top track to support the same above said studs yet allow vertical flotation of said track from said studs;

each of said stud clip members having a main web portion of a height less than the length of said C shaped stud;

a pair of opposed generally parallel narrow flanges projecting from said main web and normal to the plane of said main web;

a pair of opposed inwardly extending lip receiving recesses projecting inwardly toward each other from said flanges; and a wall extension projecting from each of said recesses and on a plane with said parallel narrow flanges, said wall extensions each engaging one of said spaced apart side walls of said top track and fixedly united therewith.

5. A building system frame as defined in claim 4 wherein said vertical metallic studs are non-load bearing and of relatively thin gauge metal.

* * * * *

UNITED STATES PATENT AND TRADEMARK OFFICE

CERTIFICATE OF CORRECTION

PATENT NO. : 5,040,345

DATED : August 20, 1991

INVENTOR(S) : Michael F. Gilmour

It is certified that error appears in the above-indentified patent and that said Letters Patent is hereby corrected as shown below:

On the title page, insert:

[73] Assignee: Angeles Metal Systems, Commerce CA.

Signed and Sealed this

Fifteenth Day of August, 1995

*Attest:*

Bruce Lehman

BRUCE LEHMAN

*Attesting Officer*

*Commissioner of Patents and Trademarks*